United States Patent [19]

Tye

[11] 4,018,470

[45] Apr. 19, 1977

[54] ANCHOR INSERT FOR EMBEDMENT IN A CONCRETE SLAB

[75] Inventor: Dennis W. Tye, Hayward, Calif.

[73] Assignee: Superior Concrete Accessories, Inc., Franklin Park, Ill.

[22] Filed: June 9, 1975

[21] Appl. No.: 584,740

[52] U.S. Cl. ..... 294/89; 52/707; 52/711

[51] Int. Cl.[2] ..... B66C 1/66; E04C 5/00

[58] Field of Search ..... 294/86 R, 89; 52/125, 52/698–704, 706–709, 711

[56] References Cited

UNITED STATES PATENTS

| | | | |
|---|---|---|---|
| 2,794,336 | 6/1957 | Ballou | 294/89 X |
| 3,216,171 | 11/1965 | Jenkins | 52/707 X |
| 3,289,379 | 12/1966 | Watts | 52/699 X |
| 3,431,012 | 3/1969 | Courtois et al. | 294/86 R |
| 3,712,014 | 1/1973 | Waerner | 52/707 |
| 3,873,147 | 3/1975 | Annable et al. | 294/89 |

*Primary Examiner*—Johnny D. Cherry
*Attorney, Agent, or Firm*—Norman H. Gerlach

[57] ABSTRACT

An improved anchor insert adapted to be embedded in a concrete slab for cooperation with a pick-up unit which includes a locking stem having a pair of lift shoulders extending from opposite sides of the stem, comprises a concrete-excluding cage having a hollow body and a base closing the lower end of the body, a first pair of spaced apart anchor rod sections intersecting the body for the application of a lifting force thereto by the lift shoulders inserted in the cage, a second pair of spaced apart anchor rod sections extending transversely of the first pair of anchor rod sections and fixedly secured thereto on opposite sides of the cage body, a pair of foot members disposed beneath each anchor rod section of the second pair, the anchor rod sections of the second pair being seated thereon, the foot members in each pair being disposed on opposite sides of the cage and spaced outwardly therefrom, and the foot members being adapted to seat on the floor of a slab form to space the anchor rod sections of both pairs inwardly from the adjacent external surface of a formed slab, and strut means extending outwardly from the base to each of the foot members and fixedly connecting the foot members to the base.

7 Claims, 6 Drawing Figures

ANCHOR INSERT FOR EMBEDMENT IN A CONCRETE SLAB

BACKGROUND OF THE INVENTION

This invention relates to an anchor insert adapted to be embedded in a concrete slab for cooperation with a pick-up unit which includes a locking stem having a pair of lift shoulders extending from opposite sides of the stem.

An anchor insert as contemplated by the invention is constructed of a plurality of rod or heavy wire sections which become embedded in a concrete slab and serve as anchor members for lifting the slab. Portions of the anchor rod sections are shielded from the surrounding concrete, and a concrete-excluding hollow cage or can has been employed for this purpose in the insert, the cage being constructed of plastic, metal or other suitable material. A plurality of inserts may be embedded at different locations in the slab. A pick-up unit is provided for each insert, and the unit is designed for releasably interengaging the insert. Hoisting apparatus is connected to the pick-up units when engaged with the inserts. The slab may be raised from the horizontal position in which it is poured, to an upright position in which it may serve as a building wall, for example. The pick-up units are removed from their engagement with the inserts and may be used repeatedly with inserts in other slabs.

U.S. Pat. No. 3,431,012 discloses an anchor insert and a pick-up unit of the general type with which the present invention is concerned. U.S. Pat. application Ser. No. 435,700, filed Jan. 23, 1974 for Anchor Insert For Embedment In A Concrete Slab, now abandoned, and the continuation thereof, application Ser. No. 568,585, filed Apr. 16, 1975, disclose an anchor insert constituting an improvement on the structure of the patent. The anchor insert of the present invention is an improvement upon and provides advantages over the insert of the foregoing applications.

The anchor inserts are designed to be set upon the floor of a concrete slab form, and they are secured in place by wiring their parts to the reinforcing bars for the slab. However, the inserts frequently are subjected to forces tending to displace and/or damage them, such as the forces applied by striking the inserts with shovels and other equipment, and by workmen stepping on some part of the insert. The forces to which the inserts are subjected may move around or tilt the inserts, damage their cage members, which preferably are constructed of plastic, so as to permit leakage of mortar into the cage, and/or destroy the support for the cage members. It would be disadvantageous if the insert structure could be improved so as to minimize such problems, thereby insuring that the inserts are properly situated, and eliminating the time wasted in resetting or replacing inserts which have been moved out of place or damaged.

SUMMARY OF THE INVENTION

The present invention provides an anchor insert adapted to be embedded in a concrete slab for cooperation with a pick-up unit which includes a locking stem having a pair of lift shoulders extending from opposite sides of the stem, the insert including a concrete-excluding cage having a hollow body and a base closing one end of the body, the opposite end of the body being adapted for insertion of the locking stem and lift shoulders into the cage, the cage being adapted to be emplaced within a form for a concrete slab with its base lowermost in the form, a first pair of spaced apart anchor rod sections intersecting the body, the anchor rod sections each defining a downwardly facing thrust surface disposed within the perimeter of the body, the thrust surfaces each being adapted for the application of a lifting force thereto by one of the lift shoulders inserted in the cage, a second pair of spaced apart anchor rod sections extending transversely of the first pair of anchor rod sections and fixedly secured thereto on opposite sides of the cage body, a pair of foot members disposed beneath each anchor rod section of the second pair, the second pair of anchor rod sections being seated on the foot members, the foot members in each pair disposed on opposite sides of the cage and spaced outwardly therefrom, the foot members extending below the first pair of anchor rod sections and being adapted to seat on the floor of a slab form to space both the first and second pairs of anchor rod sections inwardly from the adjacent external surface of a formed slab, and strut means extending outwardly from the base to each of the foot members and fixedly connecting the foot members to the base, the insert thereby being adapted for inserting the locking stem of a pick-up unit in the cage with the lift shoulders disposed beneath the thrust surfaces, and rotating the locking stem and disposing the lift shoulders to apply a lifting force to the thrust surfaces, whereby when a lifting force is imparted to the locking stem, it is transmitted to the anchor rod sections for lifting a slab in which the insert is embedded.

The invention provides a substantially improved supporting structure or foundation for the insert. The foot members joined to the base by strut means are arranged to provide broad-based support extending on all four sides of the insert, thereby assisting in prevention of tilting. The anchor rod sections of the second pair are seated on the foot members disposed therebeneath, to transfer the vertical loads imparted to the insert and avoid bending or twisting of the foot members with resultant failure thereof or of the strut means connecting the foot members to the base.

In a preferred embodiment of the invention, each of the anchor rod sections in the second pair includes a horizontal central portion seated on the foot members, an upwardly and outwardly inclined lower side portion extending from each end of the central portion, and an upwardly and inwardly inclined upper side portion extending from the outer end of each of the lower side portions, the upper side portions terminating adjacent to the vertical planes of the outer edges of their adjacent foot members, and the insert being adapted for insertion of a concrete reinforcing bar between the cage and the side portions adjacent to the junctions of the upper and lower side portions and extending transversely thereof for wiring the second pair of anchor rod sections to the reinforcing bar.

The preferred structure of the second pair of anchor rod sections functions to provide several advantages. With the second pair of anchor rod sections turned in toward the cage, tilting of the insert when the rod sections are stepped on is minimized. The second pair of anchor rod sections also shields or protects the cage from damage caused by stepping on the insert and other forces. Additionally, the bent winglike structure formed by the side portions enables such portions to be firmly secured to a reinforcing bar, by wiring, in a manner that prevents the insert from moving vertically or horizontally.

BRIEF DESCRIPTION OF THE DRAWINGS

The attached drawings illustrate a preferred embodiment of the invention, without limitation thereto. In the drawings, like elements are identified by like reference symbols in each of the views; and.

DESCRIPTION OF THE PREFERRED EMBODIMENT

Figures 1, 2, 6:
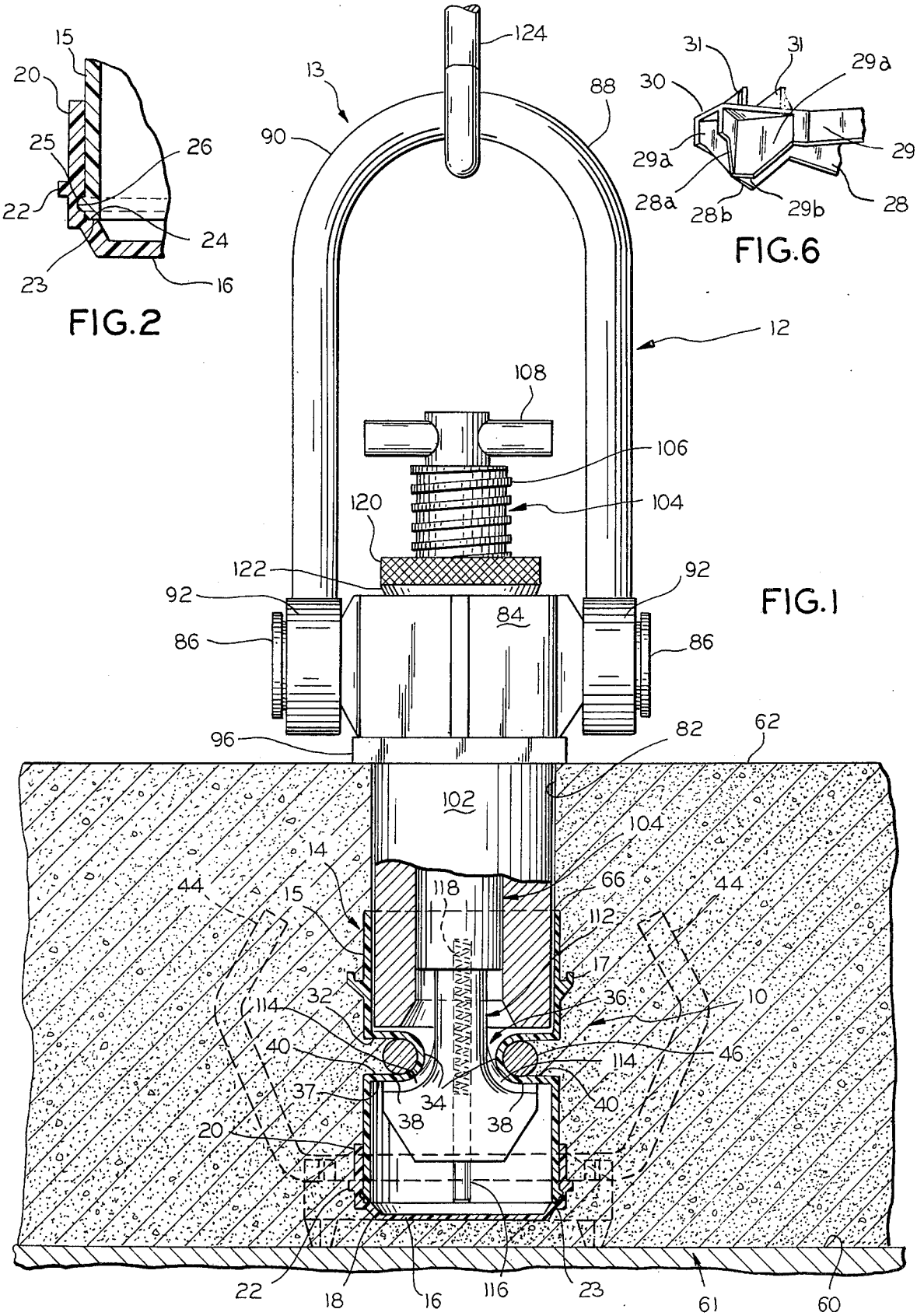
FIG. 1 is a partly side elevational and partly vertical sectional view of lifting apparatus including an assembly of a pick-up unit engaging an anchor insert according to the invention, the anchor insert being embedded in a concrete slab, the view of the insert being taken substantially on line 1—1 of FIG. 4.
FIG. 2 is an enlarged fragmentary vertical sectional view showing details of the joint between the cage body and the cage base in the anchor insert.
FIG. 6 is a bottom and side perspective view of a foot member in the anchor insert and of studs integral therewith, the studs being shown fragmentarily.

Referring to FIG. 1 of the drawings, representative apparatus for lifting a concrete slab includes the combination of an anchor insert 10 according to the invention and a conventional pick-up unit 12 constructed for interlocking engagement with each other and together forming lifting apparatus 13. The pick-up unit 12 is essentially the same as the pick-up unit illustrated and described in U.S. Pat. No. 3,431,012 and there identified by the same reference numeral 12, with but minor variations. The pick-up unit 12 is the same as the pick-up unit illustrated and described in U.S. Pat. application Ser. No. 435,700 and its continuation application, in which the pick-up unit is identified by the same reference numeral 12.

The insert 10 is designed to be embedded in multiple in a concrete slab, and a pick-up unit 12 is provided for each insert. After pouring the slab in a horizontal position with the inserts 10 embedded at suitable locations therein, a pick-up unit 12 is connected to each insert, and hoisting mechanism is connected to each pick-up unit. The hoisting mechanism is operated to elevate the slab to its desired final upright position, after which the pick-up units 12 are removed and may be reused with inserts 10 in other slabs. The inserts 10 remain in the slab, and the access openings remaining in the slab are filled with grout, to complete the operation of erecting the slab.

Referring to FIGS. 1–5, the anchor insert 10 includes a concrete-excluding cage or can 14 which is a unitary structure of a hollow single-walled body or tube 15 and a base or bottom end closure 16. Except for shoulder structure, to be described, the cage body 15 is substantially cylindrical and tubular, with its opposite ends open. The cage body 15 is encircled by an integral reinforcing ring 17.

The base 16 is a relatively shallow dish-like member having a frustoconical bottom portion 18, a slightly enlarged cylindrical tubular upper portion or collar 20 surmounting and integral with the bottom portion 18, and an integral outwardly projecting annular reinforcing flange 22 encircling the upper portion 20. As seen most clearly in FIG. 2, the lower rim or edge 23 of the body 15 fits within the upper portion 20 of the base 16 in a snug or friction fit, and seats on a shoulder 24 formed at the junction of the bottom portion 18 and the upper portion 20 of the base. A tight fit is necessary, in order to exclude mortar from the joint. For this purpose, an integral peripheral bead or ridge 25 is formed on the body 15 adjacent to its lower rim 23, and a complementary annular groove 26 is formed in the inner surface of the upper portion 20 of the body adjacent its lower end. The groove 26 receives the bead 25 in snap-fitting frictional engagement. If desired, the area adjacent to the lower rim 23 of the body 15 may be sealed to the upper portion 20, such as by a suitable sealing and/or adhesive composition, or, in the case of plastic parts, by solvent welding or fusion.

Referring to FIGS. 2–6, the cage 14 is supported on four foot members 27 which are spaced outwardly from the cage on all sides thereof, in outrigger fashion. Strut means including inside struts or flange members 28 and outside struts or flange members 29 extend outwardly from the base 16 to each of the foot members 27. The inside struts 28 join the base 16 between the flange 22 and the bottom of the base, and extend substantially horizontally to the foot members 27. The outside struts 29 join the base 16 between the flange 22 and points spaced thereabove on the upper portion 20, and extend obliquely outwardly and downwardly to the foot members 27. The struts 28 and 29 are integral with the base 16 and with the foot members 27, and thereby fixedly connect the foot members to the base. The inside struts 28 extend radially from the base 26, in pairs of opposed struts with each pair on a diameter of the base, and the respective pairs being on diameters intersecting at an inside angle of about 80°, in the illustrative embodiment. The outside struts 29 are offset from the inside struts 28.

The struts 28 and 29 are relatively thin flat bars or strips arranged with their wider sides extending vertically. As seen most clearly in FIG. 6, in each foot member 27, a generally trapezoidal or truncated triangular flat support plate **28*a* is integral with and extends outwardly in the same direction from each inside strut 28. Similarly, a generally trapezoidal or truncated triangular flat support plate 29*a* extends integrally with and angularly from the outer end of each outside strut, so that the latter support plate 29*a* and the former support plate 28*a* intersect to form webs in the foot member 27. The support plates 28*a* and 29*a* have about the same thickness as the struts, and likewise are arranged with their wider sides extending vertically. They are surmounted by an integral horizontal flat seating plate 30 of the foot member 27. The seating plate 30 in turn is surmounted by a pair of spaced parallel upstanding locating brackets or flange members 31 of the foot member 27. The lower edges 28*b* and 29*b* of the support plates 28*a* and 29*a* intersect to form an angular horizontal bottom surface or base on the foot member 27, providing essentially three-point support. In the illustrative embodiment, all of the foregoing parts of the foot members 27 are molded integrally with the struts 28 and 29 and the base 16**.

Figure 4:
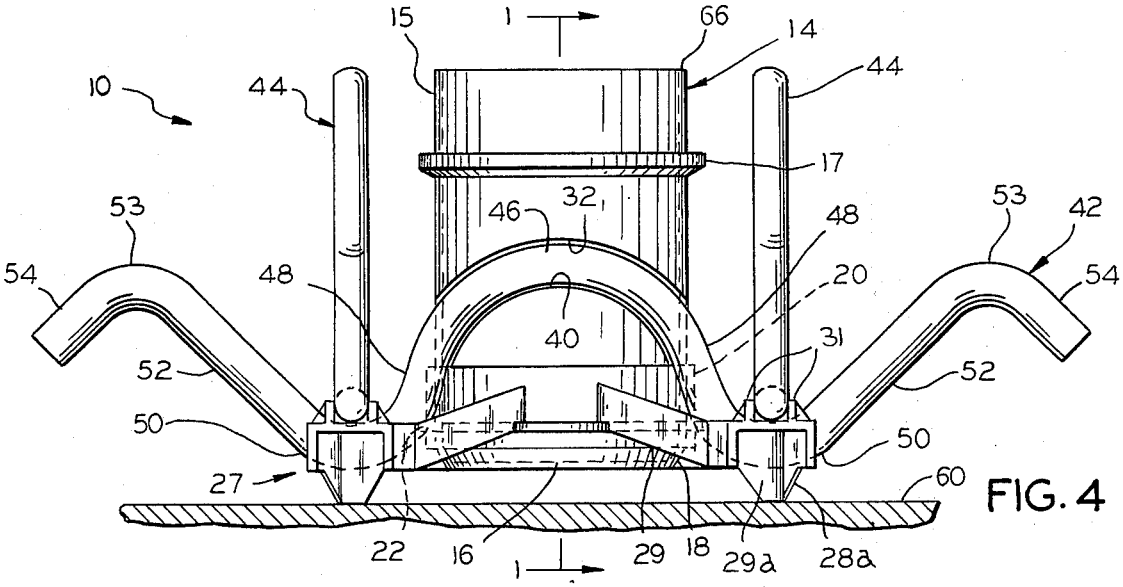
Figure 5:
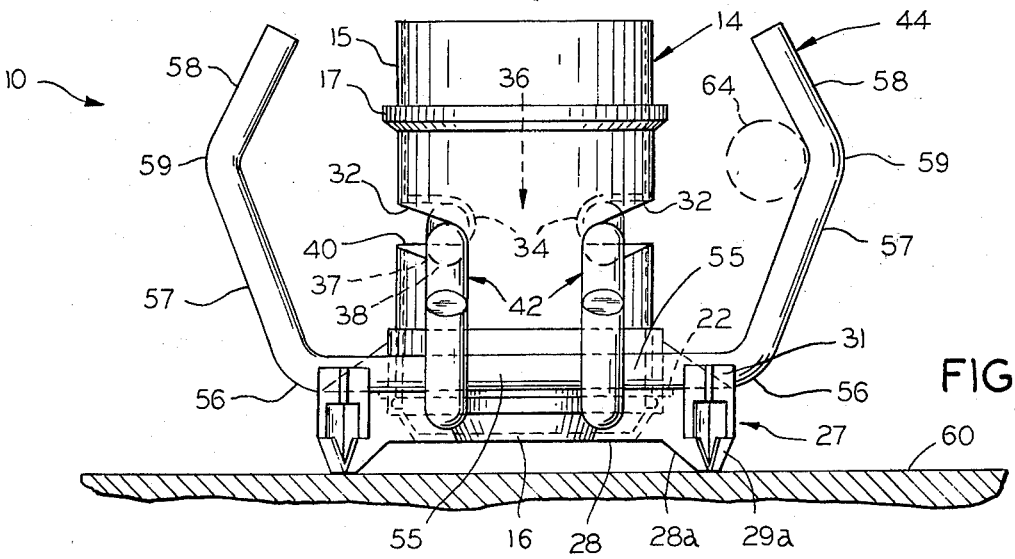

The illustrative cage body 15 is molded or otherwise formed to provide a pair of arcuate grooves or recesses 32 in spaced parallel relation on opposite sides of the body. As seen in FIG. 4, the grooves 32 are curved downwardly on a radius, and as seen in FIG. 1 and 5, the groove walls 34 are spaced apart to leave an access opening or passageway 36 between them within the body 15. The groove walls 34 provide a pair of spaced apart arcuate shoulders 37 on opposite sides of the cage body 15 and spaced from the bottom of the cage 14. The body shoulders 37 extend inwardly to define spaced apart, parallel pairs of downwardly facing arcuate internal thrust surfaces 38 and upwardly facing arcuate external lift surfaces 40. As subsequently described, the internal thrust surfaces 38 are adapted for lifting engagement with lift shoulders on the pick-up unit 12, and the external lift surfaces 40 are adapted for lifting engagement with anchor rod sections.

The cage body 15, the cage base 16, the foot members 27, and the struts 28 and 29 may be constructed of a suitable plastic material, for example, a thermoplastic polymer such as polystyrene. Alternatively, such parts may be constructed of metal or of other materials. However, it is preferred that at least the foot members 27 be constructed of plastic or other noncorroding material, to avoid problems occasioned by the formation of rust on metal surfaces close to the external surface of the concrete slab. It is further preferred that the element constituting the body 15, and the element or unit including the base 16, the foot members 27, and the struts 28 and 29, each be constructed integrally in one piece of molded material, such as a thermoplastic resin polymer, preferably, polystyrene.

Figure 3:
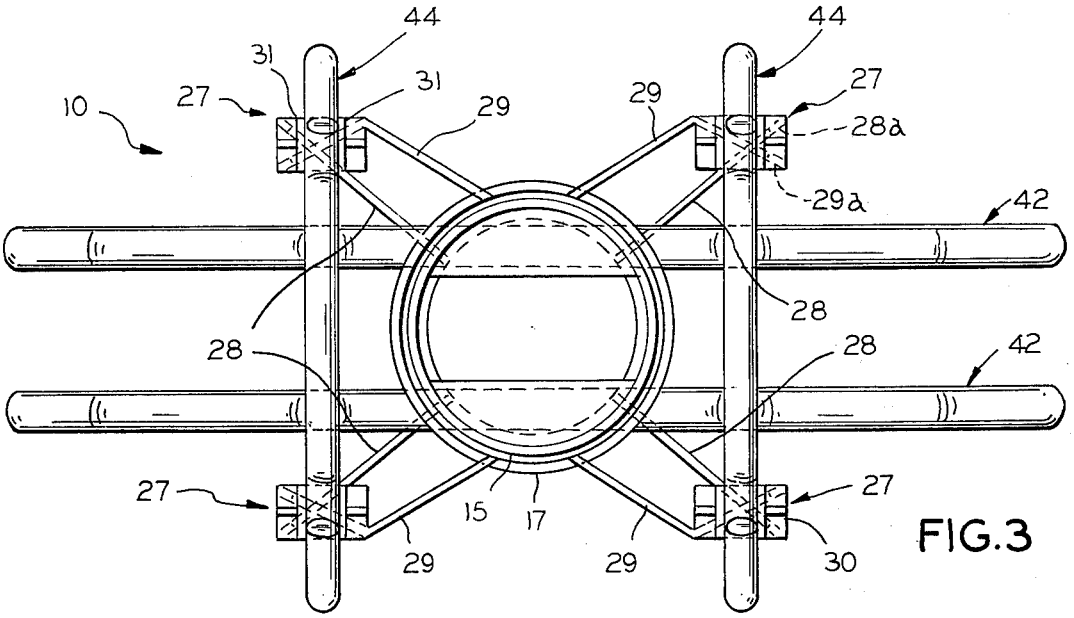
FIGS. 3, 4 and 5 are, respectively, top plan, side elevational and end elevational views of the anchor insert.

Referring particularly to FIGS. 3–5, the anchor insert 10 also includes a pair of longitudinally extending spaced parallel primary anchor rod sections 42, and a pair of transversely extending spaced parallel secondary anchor rod sections 44 affixed to the longitudinal rods 42. The anchor rod sections are smooth bent cylindrical rod or heavy wire sections, which have no protrusions thereon, particularly in the case of the primary rod sections 42. The primary anchor rod sections 42 as normally arranged on a horizontal surface lie in parallel vertical planes, and they intersect the body 15 on opposite sides of the center thereof. The secondary anchor rod sections 44 lie in parallel normally vertical planes at right angles to the planes of the primary rod sections 42, and are disposed on opposite sides of the body 15 in spaced relation thereto.

The primary anchor rod sections 42 provide the principal support for a concrete slab which is to be lifted, and the secondary anchor rod sections 44 provide a relatively small, minor proportion of the support for the slab. The lifting forces are transmitted to the anchor rod sections via the pick-up units 12, which are operatively connected to the rod sections during the lifting operation. The anchor rod sections 42 and 44 are mounted on the cage 14 for emplacement within a concrete form, and the cage serves to exclude concrete from the connective portions of the anchor insert 10 and also to support the insert on the form for pouring concrete therearound. The secondary anchor rod sections 44 perform the additional functions of securing the primary anchor rod sections 42 to the cage 14 in the proper disposition of the parts, protecting the cage 14, and serving as connecting members to concrete reinforcing bars arranged within the concrete slab form.

The primary anchor rod sections 42 are identical, and each is a sinuous rod member including a central portion 46 curving downwardly, when installed, substantially on the arc of a circle, a transition portion 48 extending from each of the opposite ends of the central portion 46, a first reverse bend portion 50 extending from each transition portion, an upwardly and outwardly inclined extension portion 52 extending from each first reverse bend portion 50, a second reverse bend portion 53 extending from each extension portion 52, and a downwardly and outwardly inclined terminal portion 54 extending from each second reverse bend portion 53. The central portion 46 of each anchor rod section 42 is received relatively snugly within one of the grooves 32 in the cage body 15, in intimate contact with the lift surface 40 therein.

The ends of the central portion 46 and the transition portions 48 extend at a relatively small angle from the vertical, which in the illustrative embodiment is about 15°, to thereby cause a large component of the initial lifting force to be exerted in the vertical direction, as will become evident subsequently. The first reverse bend portions 50 are located adjacent the bottom of the cage 14 and relatively deeply in the concrete slab, to provide a maximum thickness of concrete thereabove for absorbing and resisting the load forces. The extension portions 52 extend at angles of about 45° from the vertical, and the terminal portions 54 are approximately perpendicular thereto, in the illustrative embodiment. The primary anchor rod sections 42 are formed of steel rod or wire stock, which has a diameter of 0.442 inch in the illustrative embodiment. The structure of the primary anchor rod sections 42, especially, is designed to achieve high safe working loads.

The secondary anchor rod sections 44 are identical, and they are hexagonally-shaped five-sided members. Each of the secondary anchor rod sections 44 includes a straight, initially horizontal central portion 55, an upwardly and outwardly inclined lower side portion 57 extending from each of the opposite ends of the central portion 56, and an upwardly and inwardly inclined upper and terminal side portion 58 extending from the outer end of each of the lower side portions 57. The central portion 55 is joined to the lower side portions 57 by first obtuse angle bends 56, and the lower and upper side portions 57 and 58 are joined together by second obtuse angle bends 59. The central portions 56 of the secondary anchor rod sections 44 are affixed to the upper surfaces of the first reverse bend portions 50 of the primary anchor rod sections 42, preferably by welding. In the illustrative embodiment, the lower side portions 57 and the upper side portions 58 are inclined from the vertical in opposite directions at angles of approximately 25°. The secondary anchor rod sections 44 may have a lesser diameter than the primary anchor rod sections 42, in view of the relatively small load-carrying contribution of the secondary anchor rod sections. In the illustrative embodiment, the secondary anchor rod sections 44 are formed of steel rod or wire stock having a diameter of about 0.340 inch.

The insert 10 may be assembled in convenient manner by placing the primary anchor rod sections 42 in the grooves 32 of the cage body 15, prior to assembly of the body with the cage base 16. The assembly then may be placed in a fixture in a welding machine, after which the secondary anchor rod sections 44 are held in their proper positions and fusion welded to the primary anchor rod sections. The base 16 is assembled by pressing it in place around the bottom of the body 15, until the bead 25 on the body snaps into the groove 26 in the base, to provide an essentially waterproof seal and a joint serving to retain the cage parts together. The locating brackets 31 of the foot members 27 are adapted to embrace the secondary anchor rod sections 44, particularly the central portions 55 thereof, adjacent to the first obtuse angle bends 56. The brackets 31 serve to locate the foot members 27 so that they are directly beneath the secondary anchor rod sections 44.

As assembled, the secondary anchor rod sections 44 are seated on the foot members 27 centrally thereof, particularly on the seating plates 30 of the foot members. The foot members 27 extend below the primry anchor rod sections 42 and, as illustrated in FIG. 1, are adapted to seat on the floor 60 of a concrete slab form 61 to space both the primary anchor rod sections 42 and the secondary anchor rod sections 44 inwardly from the adjacent external surface of a formed concrete slab 62. The foot members 27 support the remainder of the insert 10, and vertical loads occasioned by individuals stepping on the insert or articles striking the same are transmitted thereto through the secondary anchor rod sections 44. Since the secondary anchor rod sections are directly over the foot members 27, the loads are transmitted to the foot members with minimum potential for twisting or turning, which might cause the foot members or the struts 28, 29 to bend or break. The broad support base provided by the foot members 27 helps prevent permanent tilting of the insert 10, inasmuch as the insert center of gravity remains over the area encompassed by the foot members through a substantial degree of tilting. The low center of gravity of the insert cooperates in the prevention of permanent tilting.

The insert 10 preferably is tied to one or more of the reinforcing bars or rebars that are arranged in the concrete form, and this arrangement further serves to secure the inserts in place. The structure of the secondary anchor rod inserts 44 is designed to cooperate with a reinforcing bar 64, illustrated in broken line in FIG. 5. The reinforcing bar 64 may be inserted between the cage 14 and the side portions 57 and 58 on one side of each secondary anchor rod section 44, adjacent to the second angle bend 59 forming the junction of the lower and upper side portions 57 and 58. The reinforcing bar extends transversely of the anchor rod sections 44, and may be wired thereto at the bends 59. The bends tend to prevent relative vertical and horizontal movement between the reinforcing bars 64 and the anchor rod sections 44, so that the insert 10 remains in place although subjected to various forces. Where reinforcing bars are employed in a grid pattern, the insert 10 may be located at one corner of a grid square and there wired to perpendicular intersecting bars, to more rigidly secure the insert in place.

When the insert 10 is arranged in a concrete form such as the form 61, the open upper rim or edge 66 is closed with a suitable closure cap, not illustrated, prior to pouring wet concrete therein, to prevent concrete from entering the cage 14 and to form an access hole 82 (FIG. 1) in the formed slab 62. This practice is well known, and a cap of the type employed is illustrated in FIG. 8 of U.S. Pat. No. 3,431,012, as identified by the number 100, and such a cap also is illustrated and described in the above-identified patent applications. The concrete is poured in the form 61 to the desired depth, covering the insert 10 and its closure cap in the process. The concrete flows beneath the base 16 and around the foot members 27. The oblique arrangement of the outside struts 29 serves to render the area beneath the base 16 more accessible for the flow of concrete thereto. When the concrete is set, access to the interior of the insert 10 is afforded by removing the closure cap, to leave the access hole 82 in the slab 62.

The manner in which the pick-up unit 12 cooperates with the anchor insert 10 also is well known, both by virtue of extensive use in the field and from the disclosure in U.S. Pat. No. 3,431,012. For convenience, the pick-up unit 12 and its cooperation with the insert 10 are briefly described hereinafter.

Referring to FIG. 1, the conventional pick-up unit 12, as described in U.S. Pat. No. 3,431,012 and in the above-identified patent applications, includes a generally tubular body 84 having a pair of diametrically opposed integral trunnions 86 extending outwardly therefrom. A lifting bale 88 having a bight 90 and a pair of terminal eyelets 92 is pivotally secured on the trunnions 86, which project through the eyelets. A flat, rectangular bearing plate 96 is integral with the base of the body 84. A cylindrical bearing sleeve 102 is loosely received within the body 84.

A locking torque stem 104 is inserted through the body 84 and through the sleeve 102, fitting loosely therein. The stem 104 includes an outer or upper rolled or contour thread portion 106 having an operating handle 108 secured thereto, and a T-head 112 at its lower end. The T-head includes a pair of transversely arcuate lift shoulders 114, rounded across their widths or having contours in general complementary to those of the cage thrust surfaces 38. The T-head 112 is oblong, and it extends in the direction of its lift shoulders 114 radially outwardly from the axis of the stem 104, for a diameter or width at least equal to the corresponding diameter of the thrust surfaces 38. In a direction transverse thereto, the width of the T-head 112 is less than the width of the opening 36 between the groove walls 34, so that the T-head will pass between such walls when the head is properly oriented.

A spring-pressed plunger or pin 116 is vertically slidably mounted in a corresponding opening in the T-head 112, and it is surged outwardly at the bottom of the T-head by the pressure of a plunger spring 118, held captive within the T-head. A lock nut 120 is received on the threaded portion 106 of the stem 104. The lock nut 120 is provided with a spherically curved bottom 122 which is seated and turns in the manner of a ball-and-socket joint on a correspondingly curved seat on the body 84.

The pick-up unit 12 is connected to the anchor insert 10 by inserting the T-head 112 and the bearing sleeve 102 into the hole 82 in the slab 62, and thereafter within the rim 66 of the cage body 15 and further into the body, as illustrated in FIG. 1. With the bearing plate 96 seated on the surface of the slab 62, and with the lock nut 120 loose on the stem 104 above the pick-up unit body 84, the operating handle 108 is oriented so that the T-head 112 is in a rotational position perpendicular to the position illustrated in FIG. 1, i.e., perpendicular to the face of the drawing, thus enabling the T-head to pass between the groove walls 34 of the cage body 15. The stem 104 is supported by the plunger 116, which is seated on the cage base 16. The operator presses on the handle 108 to depress the stem 104 against the tension of the plunger spring 118, and move the T-head 112 to a position beneath the projecting groove walls 34 and the body shoulders 37. The handle 108 then is rotated through an angle of 90° and released, whereupon the T-head 112 enters the position illustrated in FIG. 1. At this time, the lift shoulders 114 of the T-head are in lifting engagement in contact with the internal thrust surfaces 38 on the body shoulders 37, under the pressure of the plunger spring 118. The external lift surfaces 40 on the body shoulders 37 are in lifting engagement in contact with the downwardly facing thrust surfaces on the lower sides of the central portions 46 of the primary anchor rod sections 42. As the next step, the lock nut 120 is threaded down on the stem 104 until it reaches its seat in the pick-up unit body 84, and then it is backed off slightly to permit free relative rotation of the parts. Thereafter, a hoisting hook 124, illustrated fragmentarily, may be connected to the bight portion 90 of the bale 88, to begin a lifting sequence.

A pick-up unit 12 is connected to each anchor insert 10 in the slab 62 in the same manner, each pick-up unit 12 is connected to a hoisting hook 124 or the like in the same manner, and hoisting apparatus connected to the hooks 124 is employed to raise the concrete slab 62. Ultimately, the slab is raised to a vertical position, while the bale 88 turns on the trunnions 86 as the slab changes its angular relation to the hoisting apparatus. When the slab has been elevated to its final position, it is secured by suitable bracing. Each pick-up unit 12 then is removed by exerting inward pressure on the operating handle 108, turning the locking stem 104 and thus the T-head 112 through an angle of 90°, and pulling the bale 88 outwardly. The hole 82 remaining in the slab 62 is filled with grout, to finish the surface of the slab.

The anchor insert 10 illustrated represents a preferred embodiment of the invention, as being adapted for rapid and economical manufacture and assembly, while reliably excluding mortar from the interior of the cage 14 when in use. However, the invention is not limited to the specific illustative structure. Thus, for example, instead of employing a cage 14 having grooves 32 in the body 15 thereof for reception of the primary anchor rod sections 42, the primary anchor rod sections may extend through the wall of the body, in the manner of the anchor rods 16 which extend through the wall 44 of the cage 40 in the structure of U.S. Pat. No. 3,431,012, as seen in FIG. 1 thereof, which figure also illustrates the disposition of the medial regions 30 of the rod sections within the wall 44 for contacting engagement with the T-head 74 within the cage. Likewise, it will be apparent to those skilled in the art that various other changes and modifications may be made in the preferred illustrative embodiment within the spirit and scope of the invention. It is intended that all such changes and modifications be included within the scope of the appended claims.

Having thus described the invention, what I claim as new and desire to secure by Letters Patent is:

1. In an anchor insert adapted to be embedded in a concrete slab for cooperation with a pick-up unit which includes a locking stem having a pair of lift shoulders extending from opposite sides of the stem, said insert including a concrete-excluding cage having a single-walled hollow body and a base closing one end of the body, the opposite end of said body being adapted for insertion of said locking stem and lift shoulders into the cage, said cage being adapted to be emplaced within a form for a concrete slab with its base lowermost in the form, a pair of spaced apart shoulders formed in the wall of said cage body on opposite sides of the body and spaced from said base, said body shoulders extending inwardly of the body to define a pair of downwardly facing internal thrust surfaces on one side of said wall each adapted for lifting engagement in contact with one of said lift shoulders inserted in said cage, said body shoulders also defining a pair of upwardly facing external lift surfaces on the reverse side of said wall each adapted for lifting engagement in contact with an anchor rod section, and a first pair of spaced apart anchor rod sections each defining a downwardly facing thrust surface contacting one of said lift surfaces on the body, whereby said locking stem of a pick-up unit may be inserted in said cage with said lift shoulders disposed beneath said body shoulders, said locking stem thereafter may be rotated and said lift shoulders may be brought into lifting engagement in contact with said thrust surfaces on the body, and a lifting force when imparted to said locking stem is transmitted to said anchor rod sections for lifting a slab in which the insert is embedded, the combination with a second pair of spaced apart anchor rod sections extending transversely of said first pair of anchor rod sections and fixedly secured thereto on opposite sides of said body, a pair of foot members disposed beneath each anchor rod section of said second pair, said second pair of anchor rod sections being seated on said foot members, said foot members in each pair being disposed on opposite sides of said cage and spaced outwardly therefrom, said foot members extending below said first pair of anchor rod sections and being adapted to seat on the floor of a slab form to space both said first and second pairs of anchor rod sections inwardly from the adjacent external surface of a formed slab, and strut means extending outwardly from said base to each of said foot members and fixedly connecting the foot members to the base.

2. An anchor insert as claimed in claim 1 and wherein each anchor rod section in said second pair includes a horizontal central portion seated on said foot members, an upwardly and outwardly inclined lower side portion extending from each end of said central portion, and an upwardly and inwardly inclined upper side portion extending from the outer end of each of said lower side portions, said upper side portions terminating adjacent to the vertical planes of the outer edges of their adjacent foot members, and the insert being adapted for insertion of a concrete reinforcing bar between said cage and said side portions adjacent to the junctions of the upper and lower side portions and extending transversely thereof for wiring the second pair of anchor rod sections to the reinforcing bar.

3. An anchor insert as claimed in claim 2 and wherein each of said foot members includes a pair of spaced apart upstanding locating brackets adapted to embrace the anchor rod section seated on the foot member.

4. An anchor insert as claimed in claim 3 and wherein each of said cage body and said cage base with attached strut means and foot members is a one-piece molded plastic element, and the two elements are secured together at a substantially mortar-tight joint.

5. An anchor insert as claimed in claim 1 and wherein each of said foot members includes a pair of spaced apart upstanding locating brackets adapted to embrace the anchor rod section seated on the foot member.

6. In an anchor insert adapted to be embedded in a concrete slab for cooperation with a pick-up unit which includes a locking stem having a pair of lift shoulders extending from opposite sides of the stem, said insert including a concrete-excluding cage having a hollow body and a base closing one end of the body, the opposite end of said body being adapted for insertion of said locking stem and lift shoulders into the cage, said cage being adapted to be emplaced within a form for a concrete slab with its base lowermost in the form, and a first pair of spaced apart anchor rod sections intersecting said body, said anchor rod sections each defining a downwardly facing thrust surface disposed within the perimeter of said body, and said thrust surfaces each being adapted for the application of a lifting force thereto by one of said lift shoulders inserted in said cage, whereby said locking stem of a pick-up unit may be inserted in said cage with said lift shoulders disposed beneath said thrust surfaces, said locking stem thereafter may be rotated and said lift shoulders may be disposed to apply a lifting force to said thrust surfaces, and a lifting force when imparted to said locking stem is transmitted to said anchor rod sections for lifting a slab in which the insert is embedded, the combination with a second pair of spaced apart anchor rod sections extending transversely of said first pair of anchor rod sections and fixedly secured thereto on opposite sides of said body, a pair of foot members disposed beneath each anchor rod section of said second pair, said second pair of anchor rod sections being seated on said foot members, each of said foot members including a pair of spaced apart upstanding locating brackets adapted to embrace the anchor rod section seated on the foot member, said foot members in each pair being disposed on opposite sides of said cage and spaced outwardly therefrom, said foot members extending below said first pair of anchor rod sections and being adapted to seat on the floor of a slab form to space both said first and second pairs of anchor rod sections inwardly from the adjacent external surface of a formed slab, and strut means extending outwardly from said base to each of said foot members and fixedly connecting the foot members to the base.

7. An anchor insert as claimed in claim 6 and wherein each anchor rod section in said second pair includes a horizontal central portion seated on said foot members, an upwardly and outwardly inclined lower side portion extending from each end of said central portion, and an upwardly and inwardly inclined upper side portion extending from the outer end of each of said lower side portions, said upper side portions terminating adjacent to the vertical planes of the outer edges of their adjacent foot members, and the insert being adapted for insertion of a concrete reinforcing bar between said cage and said side portions adjacent to the junctions of the upper and lower side portions and extending transversely thereof for wiring the second pair of anchor rod sections to the reinforcing bar.

* * * * *